US006578488B2

(12) United States Patent
Strauss et al.

(10) Patent No.: US 6,578,488 B2
(45) Date of Patent: Jun. 17, 2003

(54) SAFETY DEVICE FOR A PYROTECHNIC IMPACT FUSE OF A BALLISTIC HIGH EXPLOSIVE SHELL

(75) Inventors: Hans Strauss, Reichenschwand (DE); Hans Pauly, Rothenbach (DE); Gerald Rieger, Nuremberg (DE); Manfred Schildknecht, Eckental (DE)

(73) Assignee: Diehl Munitionssysteme GmbH & Co. KG, Röthenbach (DE)

( * ) Notice: Subject to any disclaimer, the term of this patent is extended or adjusted under 35 U.S.C. 154(b) by 0 days.

(21) Appl. No.: 09/891,991

(22) Filed: Jun. 26, 2001

(65) Prior Publication Data

US 2001/0054365 A1 Dec. 27, 2001

(30) Foreign Application Priority Data

Jun. 27, 2000 (DE) ..... 100 31 301

(51) Int. Cl.[7] ..... F42C 15/34
(52) U.S. Cl. ..... 102/272
(58) Field of Search ..... 102/222, 223, 102/229, 233, 239, 244, 255, 256, 272, 275.11, 247

(56) References Cited

U.S. PATENT DOCUMENTS 3,636,879 A * 1/1972 Benner ..... 102/255
3,750,590 A * 8/1973 Fisher ..... 102/229
4,421,031 A * 12/1983 Carter et al. ..... 102/222
4,457,232 A * 7/1984 Post ..... 102/233
4,487,127 A * 12/1984 Lueebbers ..... 102/222
4,574,702 A * 3/1986 Brandt ..... 102/244
4,632,033 A * 12/1986 Gordon et al. ..... 102/239
H492 H * 7/1988 Kong et al. ..... 102/223
4,827,846 A * 5/1989 Smolnik ..... 102/256
4,953,475 A * 9/1990 Munach et al. ..... 102/228
4,982,664 A * 1/1991 Norton ..... 102/272

FOREIGN PATENT DOCUMENTS

GB 260470 11/1926

* cited by examiner

*Primary Examiner*—Charles T. Jordan
*Assistant Examiner*—Bret Hayes
(74) *Attorney, Agent, or Firm*—Scully Scott, Murphy & Presser

(57) ABSTRACT

A fuse-less shell (10) with a so-called pyrotechnic impact fuse achieves bore safety and safety in front of the bore by providing a spring-supported ball (43) arranged in a central bore (72) within a valve body (65). The valve body (65) separates an explosive charge (60) at the shell side from an impact-sensitive firing charge (28). The firing charge (28) is disposed within a shell cap (24) and surrounds a projection (30), which acts as an anvil, of the valve body (65).

6 Claims, 2 Drawing Sheets

SAFETY DEVICE FOR A PYROTECHNIC IMPACT FUSE OF A BALLISTIC HIGH EXPLOSIVE SHELL

BACKGROUND OF THE INVENTION

1. Field of the Invention

The invention concerns a safety device for a pyrotechnic impact fuse of a ballistic high explosive shell comprising a pyrotechnically reactive material which is initiated upon impact, whereby a ball safety device only passes into an armed position after the launch of the shell. A central initiation passage is arranged in a penetration passage of a valve body and is provided with a ball guide with spaced end abutments for a ball mounted therein, and including lateral firing passages which open into the central initiation passage behind the ball in the armed position of the ball safety device.

2. Discussion of the Prior Art

A safety device of that kind for a pyrotechnic percussion or impact fuse is known from DE 195 44 458.2-21. A pyrotechnic material which is fired upon impact is disposed in the ogive of the shell. The internal space in the shell is connected to the space in which the pyrotechnic material is disposed, by way of a central firing passage. Lateral firing passages open into the firing passage. The central firing passage is also intended to accommodate a ball. The function of this arrangement is to afford bore safety, in other words, while the shell is passing through the barrel, any firing of the pyrotechnic material is sealed off by the ball in the firing passage so that the explosive charge in the interior of the shell body cannot be fired.

SUMMARY OF THE INVENTION

The object of the invention is to enhance the operational reliability of the ball safety device.

The greater degree of functional reliability of the ball safety device is afforded by the spring element which acts on the ball. The spring element ensures that the ball is seated in the safe position in a condition of being displaced back in the direction of the base, in a simple manner. In that situation the ball seals off the central firing passage at the periphery thereof. It has surprisingly been found that any firing gases or vapours which possibly pass around the ball are stopped or rendered harmless by the spring element to such an extent that the subsequently arranged boosting charge is not fired. Any firing gases or vapours experience multiple reduction due to the spring element which is also in a condition of contact therearound and are in part deflected in a centripetal direction where they are mutually reduced or nullified in respect of their energy.

BRIEF DESCRIPTION OF THE DRAWINGS

An embodiment of the invention is illustrated in the drawing in which.

DETAILED DESCRIPTION OF A PREFERRED EMBODIMENT

Figure 1:
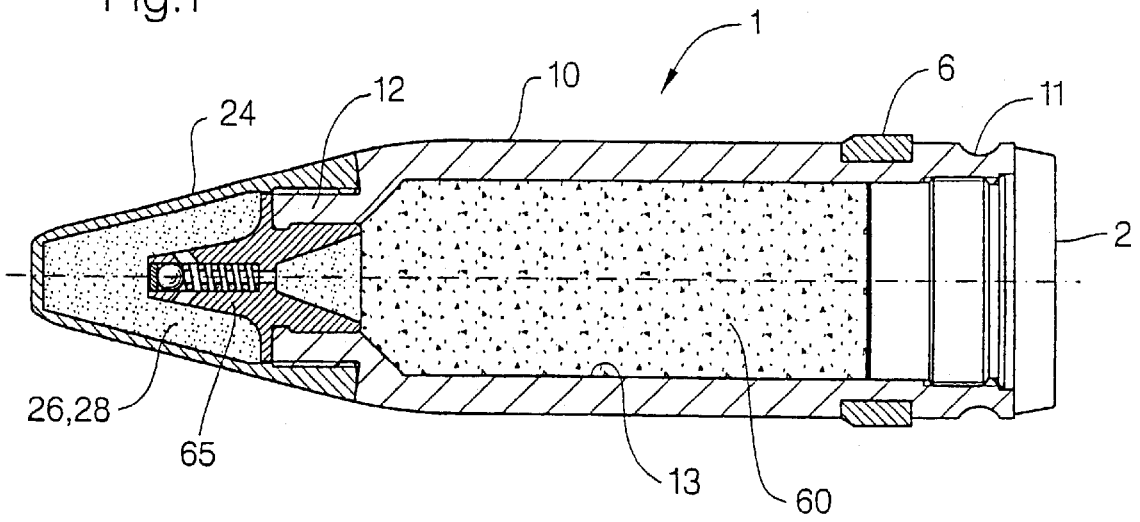
FIG. 1 is a view in longitudinal section of a shell.

A ballistic shell 1 of a 40 mm calibre comprises a shell body 10 with an annular groove 11 for a propellent charge sleeve (not shown), a one-piece screwthreaded ring 12, a guide ring 6, a base screw 2, a hollow space or cavity 13 with an explosive charge 60, a valve body 65 and a cap 24.

The valve body 65 and the cap 24 are screwed to the screwthreaded ring 12 by way of screwthread connections 66 and 67.

Disposed in the hollow space 26 between the valve body 65 and the shell cap 24 is a firing charge 28 comprising an impact-sensitive explosive.

The valve body 65 bears with a collar 68 both against an end face 69 of the screwthreaded ring 12 and also with a collar 70 against an annular face 71 of the shell cap 24. Those structural features prevent so-called through-firing of explosive gases or vapours from the detonated impact-sensitive explosive 28 to the explosive charge 60, such through-firing effect occurring at the periphery of the arrangement.

In addition the collar 68 protects the armour-piercing screwthreaded ring 12 from the explosive action of the impact-sensitive firing charge 28. The step portion 15 of the shell body 10 also contributes to the armour-piercing capability.

A transition 9 from the cylindrical inside wall 16 to the cone 17 of the shell body 10 forms a desired-rupture location which is indicated as a wavy line 8. Upon detonation of the explosive charge 60 the shell body 10 tears at the desired-rupture location 8 and accelerates the step portion 15 with the screwthreaded ring 12 in the form of a one-piece part for the purposes of piercing armour.

A projection portion 30 of the valve body 65 has lateral firing passages 41 and a two-stage central bore 72. The central bore 72 is divided into a ball guide 42 with a ball 43, a plate member 44 which is held in place by a crimp flange, a compression coil spring 73 and a bore 77.

The ball 43 comprises brass and provides sealing integrity at the periphery thereof in particular in a portion 74 of the central bore 72, insofar as the periphery of the ball 43 is supported with a close clearance in the ball guide 42. The ball 43 can also comprise another material such as steel or plastic material.

The compression coil spring 73 is slightly prestressed between a shoulder 75 and the ball 43. It has a central passage 76 in the usual way. The diameter of the bore 77 of the central bore 72 approximately corresponds to the diameter of the central passage 76.

A conical charge 29 comprising a secondary explosive is arranged in a conical recess 80 adjoining the bore 77. That conical charge 29 serves as a boosting charge. The conical charge 29 bears with its large base 31 over a large area against the explosive charge 60. In that way the charge 29 has a high pulse action, in the sense of a pointed conical hollow charge.

The hollow space 13 in the shell body 10 is provided at the ogive side with a conical portion 14. The explosive charge 60 correspondingly bears with its conical portion 63 against the conical charge 29. The conical portion 63 has a free end face 62 which is in contact with the base 31 of the charge 29 in such a way as almost to cover the area thereof, that is to say almost 100%.

Figure 3:
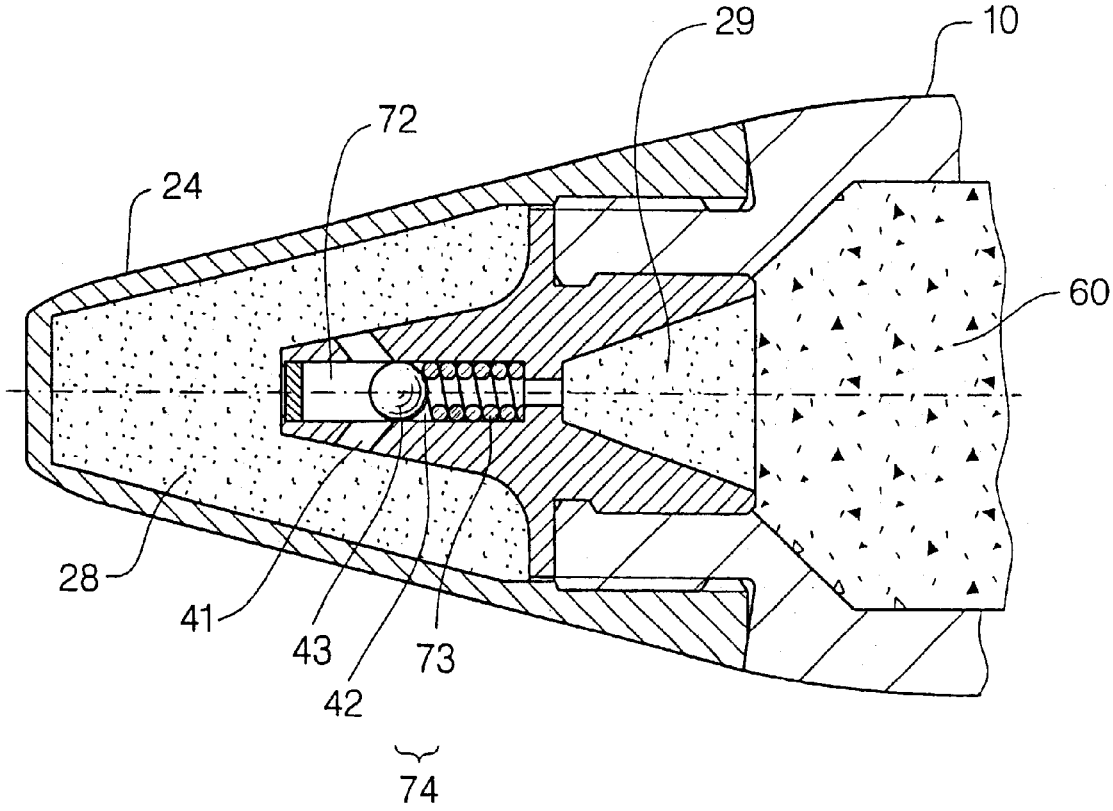
FIG. 3 shows the portion of FIG. 2 in a safety function.

During the acceleration of the shell 1 in a cannon (not shown) the ball 43 is carried on the compressed compression coil sprint 73 as shown in FIG. 3, by virtue of the mass inertia of the ball 43.

While the shell 1 is passing through the barrel and during the subsequent part of its trajectory of between 2 and 3 meters, the arrangement guarantees that firing of the firing charge 28 due to any random event does not result in firing of the conical charge 29 and thus firing of the explosive charge 60. The ball 43 seals off the central bore 72 in the portion 74 at the periphery in respect of pressure and firing gases and vapours. That affords bore safety and also safety in front of the bore for between about 2 and 3 meters in front of the barrel.

If the firing charge 28 should be fired either while the shell is passing through the bore or outside the bore, that is to say in the region of safety in front of the bore, the shell 1, after termination of the ballistic trajectory, is a dud which can be readily cleared.

Dangerous firing means are not to be found either in the fired firing charge 28 or in the unfired firing charge 28.

Figure 2:
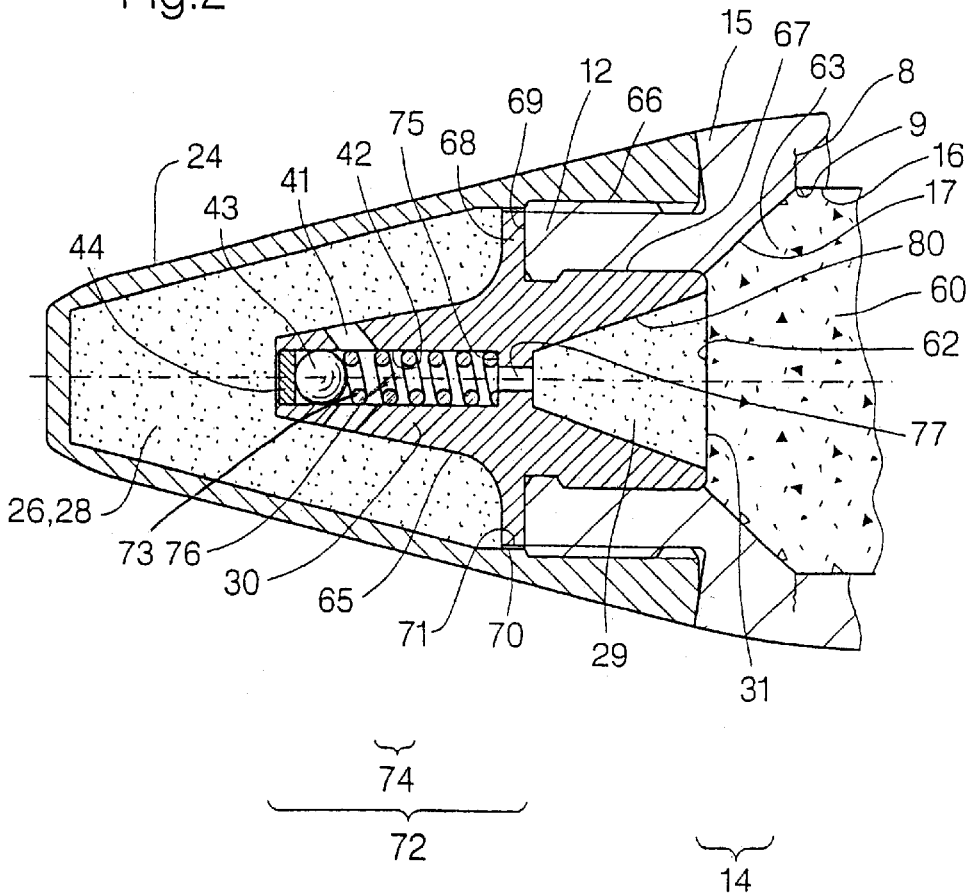
FIG. 2 shows a view on an enlarged scale of a portion of the shell shown in FIG. 1.

After the phase involving safety in front of the bore, that is to say after the ball 43 has been moved by the compression coil spring 73 out of the sealing position in FIG. 3 into the armed position shown in FIG. 2, the firing charge 28 is fired upon impact of the shell 1 against the target. The firing charge 28 is pressed shock-like against the projection portion 30 of the valve body 65, which acts as an anvil, and fired as a result. Firing vapours and gases pass under high pressure through the lateral firing passages 41 into the free central bore 72 and fire the conical charge 29. That then fires the explosive charge 60. In that way the shell 1 detonates, with fragmentation of the shell body 10.

In the case of a lightly armoured target the firing charge 28 admittedly detonates. At the same time the armour is pierced. The screwthreaded ring 12 with the step portion 15 produces the penetration effect so that detonation of the shell 1 occurs in the interior of the target.

What is claimed is:

1. A safety device for a pyrotechnic impact fuse of a ballistic high explosive shell, comprising a pyrotechnically reactive material which is initiated upon impact, wherein a ball safety device only passes into the armed position after launch of a shell, and wherein a central initiation passage (72) is arranged in a penetration passage of a valve body (65) and is provided with a ball guide (42) with spaced end abutments (44, 75) for a ball (43) mounted therein, and lateral firing passages (41) open into the central initiation passage (72) behind the ball (43) in the armed position, characterized in that a prestressed spring element (73) is disposed between the ball (43) and the abutment (75) which faces towards a secondary explosive charge, and the ball (43) in the safe position seals off the initiation passage (72) with the lateral firing passages (41) opening into the initiation passage (72), against firing vapors flowing therethrough.

2. A safety device according to claim 1 characterised in that the ball (43) is in peripheral sealing relationship with a wall formed by the firing passage in the ball guide (42).

3. A safety device according to claim 1 characterised in that the ball (43) is selected from the group of materials consisting of steel, brass or plastic material.

4. A safety device according to claim 1 characterised in that the spring element comprises a compression coil spring (73) with a central passage (76).

5. A safety device according to claim 1 characterised in that a penetration core is formed on a body of the shell (10).

6. A safety device according to claim 1 characterised in that the valve body (65) has a rear facing end portion with a conically enlarging opening (80) containing an explosive charge (29) which is in contact over a large area of a main explosive charge (60) of the high explosive shell (1).

* * * * *